US005441275A

United States Patent [19]

Yoshishita

[11] Patent Number: 5,441,275

[45] Date of Patent: Aug. 15, 1995

[54] GOLF SWING TRAINING DEVICE

[76] Inventor: Yukio Yoshishita, 1715 Odaka, Yonago-city, Tottori-pref., 689-35, Japan

[21] Appl. No.: 264,072

[22] Filed: Jun. 22, 1994

[30] Foreign Application Priority Data

Jun. 24, 1993 [JP] Japan ..... 5-153900

[51] Int. Cl.[6] ..... A63B 69/36

[52] U.S. Cl. ..... 273/191 A

[58] Field of Search ..... 273/191 A, 191 R, 192, 273/186.1

[56] References Cited

U.S. PATENT DOCUMENTS 3,341,208 9/1967 Marcella ..... 273/191 A 4,280,701 7/1981 Beckish ..... 273/191 A

*Primary Examiner*—George J. Marlo

*Attorney, Agent, or Firm*—Staas & Halsey; James D. Halsey, Jr.

[57] ABSTRACT

A golf swing training device includes an upper pivot member mounted on a support member disposed on a base frame, a lower pivot member disposed on a bottom frame portion of the base frame, and a swing path guide loop defining a swing plane and attached to the upper and lower pivot members such that said swing path guide loop is incapable of pivoting about an axis passing through said upper and lower pivot portions during the backswing, is capable of pivoting in one direction about the axis under the force of the club during the follow-through, and when pivoted during the follow-through, is capable of automatically returning its original positon. The golf swing training device thus constructed is able to assist the player in acquiring a correct swing achieved in the swing plane throughout the movement of a club including the backswing, downswing, impact and follow-through.

16 Claims, 11 Drawing Sheets

GOLF SWING TRAINING DEVICE

BACKGROUND OF THE INVENTION

1. Field of the Invention

The present invention relates to a golf swing training device for enabling the player to train or practice the swing along a swing path guide loop set in a plane which is drawn by the clubhead when a correct swing is achieved.

2. Description of the Prior Art

The swing plane is the imaginary circle round which the clubhead travels during the swing. It is like an angled disk formed by the evolution of a line which is obtained by interconnecting the midpoint between shoulders of a player and the clubhead at address. For a purpose of assisting beginners to acquire a good golf swing achieved such as to draw an arc on the right swing plane, various golf swing training devices have been proposed such as disclosed, for example, in Japanese Patent Laid-open Publication No. 60-111672 and Japanese Utility Model Laid-open Publication No. 55-51279.

The golf swing training device disclosed in Japanese Patent Laid-open Publication No. 60-111672, for enabling the player to acquire the knack of swinging the clubhead along the right swing plane, includes a backwardly tilted ring-shaped rear guide supported on a base by a plurality of support bars or posts in such a manner that the tilt angle and the height of the rear guide can be adjusted. The training device further has a generally C-shaped front guide disposed on the front side of the ring-shaped rear guide along a portion of the full circumference of the ring-shaped rear guide so as to define between the front and rear guides an arcuate clearance extending along the swing plane. When achieving a golf-swing training, the clubhead is guided on the swing plane, with the shaft of a golf-club received in the clearance between the front and rear guides. However, due to the limited length of the C-shaped front guide, the shaft is freed from guided engagement with the front and rear guides after the impact, namely during the follow-through. Thus, the disclosed training device is unable to ensure that the player trains to perform the full swing along the swing plane in a free or non-restricted manner.

The golf swing training device disclosed in Japanese Utility Model Laid-open Publication No. 55-51279 includes a circular ring having a thickness at least engageable with soled clubs. To enable the player to draw a swing plane, the ring is pivotally mounted on a support base to draw the swing plane such that the angle and the height of the ring can be adjusted. However, the ring is not pivotally movable during the follow-swing. Accordingly, if the club deviates from the swing plane during the follow-through, the player has a feeling of physical disorder due to a resistance transmitted from the ring via the golf-club (hereinafter referred to, for brevity, as "club").

Another golf swing training device is disclosed in Japanese Patent Laid-open Publication No. 47-47743, which includes a tilted support member substantially aligned with the swing plane and provided with a guide means for guiding the clubhead during the backswing and the follow-through. Due to the provision of the guide means, the player cannot perform the full swing along the swing plane in a free or unrestricted condition, as in the case of the training device disclosed in Japanese Patent Laid-open Publication No. 60-111672. In addition, since a fore-swing path member and a backswing path member that constitute the guide means are secured to the support member, they will produce a substantial frictional resistance when the club swing deviates from the swing plane. Thus, a smooth and resistance-free swing training cannot be achieved.

Still another golf swing training device is disclosed in Japanese Utility Model Laid-open Publication No. 49-67772. The disclosed training device includes a swing path loop molded of a synthetic resin and having a circular cross section. An inner loop formed from a metal pipe is attached by bolt-and-nut fasteners to the inner periphery of the swing path loop so as to support and reinforce the swing path loop at several portions circumferentially spaced at equal intervals. The swing path loop is immovable throughout the movement of the club, namely during the full swing which starts from the backswing and is ended to the follow-through. Accordingly, if the swing deviates from the swing plane, the player is unable to swing the club smoothly due to a considable resistance acting between the swing path loop and the club.

SUMMARY OF THE INVENTION

In view of the foregoing drawbacks of the prior art, it is a general object of the present invention to provide a golf swing training device including structural features which enable the player to perform the full swing (beginning from the backswing and ended to the follow-through) smoothly along a swing path guide loop.

A more specific object of the present invention is to provide a golf swing training device including a swing path guide loop which is incapable of pivoting during the backswing, which is capable of pivoting in one direction under the force of a club during the follow-through, and which when pivoted, is capable of automatically returning to its original position.

Another object of the present invention is to provide a golf swing training device which is capable of protecting the club against damage, such as abrasion wear, caused due to sliding engagement with the swing path guide loop.

A golf swing training device according to the present invention includes a base frame having a bottom frame portion, a support member disposed on the base frame and including an upper pivot member, a lower pivot member disposed on the bottom frame portion, and a swing path guide loop defining the swing plane and attached to the upper and lower pivot members such that the swing path guide loop is incapable of pivoting about an axis passing through the upper and lower pivot portions during the backswing, is capable of pivoting in one direction about the axis by the force of the club during the follow-through, and when pivoted during the follow-through, is capable of automatically returning to its original position.

Preferably, the golf swing training device further includes a mechanism for changing an intended flight direction of a ball which is determined by the swing plane defined by the swing path guide loop, and an indicator for indicating the intended flight direction of the ball.

The golf swing training device may further has a mechanism for adjusting the tilt angle of the swing path guide loop, and an indicator for indicating the tilt angle of the swing path guide loop.

Preferably, the base frame of the golf swing training device is composed of a pair of symmetrical frame halves each formed from one pipe bent into a desired configuration, and a pair of tubular joint members each slidably fitted over one of two pairs of free ends of the pipes of the frame halves to join the frame halves.

The golf swing training device preferably has a club protection member attached to that side of an outer surface of the swing path guide loop which is subjected to sliding engagement with the club, for protecting the club against damage. The club protection member may includes a synthetic resin round string slidable engageable with the club. The round string has a low friction coefficient and a diameter much smaller than the outside diameter of a pipe forming the swing path guide loop.

In use of the golf swing training device, a player or trainee first sets the plane of the swing path guide loop in alignment with the intended flight direction of a ball. Then, the tilt angle of the swing path guide loop is set to an optimum value in view of the height of the player and the length of a club used. After the setting, the player moves into the swing path guide loop.

A ball is placed on a position which is located forwards of a crossbar of the bottom frame portion and which is spaced forwardly from the lower end of the swing path guide loop by a predetermined distance. The player makes a complete movement of the club known as the full swing including the backswing, downswing, impact and follow-through. During the full swing, a lower portion of the club slides on and along the club protection member attached to the outside surface of the swing path guide loop along the full circumference of the latter.

The swing path guide loop is attached to the upper and lower pivot members such that during the backswing, the swing path guide loop is incapable of pivoting about an axis passing through said upper and lower pivot members, during the follow-through, the swing path guide loop is capable of pivoting in one direction about the axis under the force of a club, and when pivoted, the swing path guide loop is capable of automatically returning to its original position. With this construction, the player is able to acquire a correct backswing achieved in the right swing plane. If the follow-through is deviated from the swing plane due to a bad way of the player's swing, such as the slice, the swing path guide loop pivots under the force of the club. The player can, therefore, correct the bad way of swing without having a feeling of resistance and continue to perform a smooth and resistance-free training of the swing.

When the training is finished, the base frame, support member and swing path guide loop can readily be disassembled. They can readily be assembled together when the golf swing training is to be restarted.

The above and other objects, features and advantages of the present invention will become manifest to those versed in the art upon making reference to the detailed description and the accompanying sheets of drawings in which preferred structural embodiments incorporating the principles of the present invention are shown by way of illustrative example.

DETAILED DESCRIPTION

Figure 1:
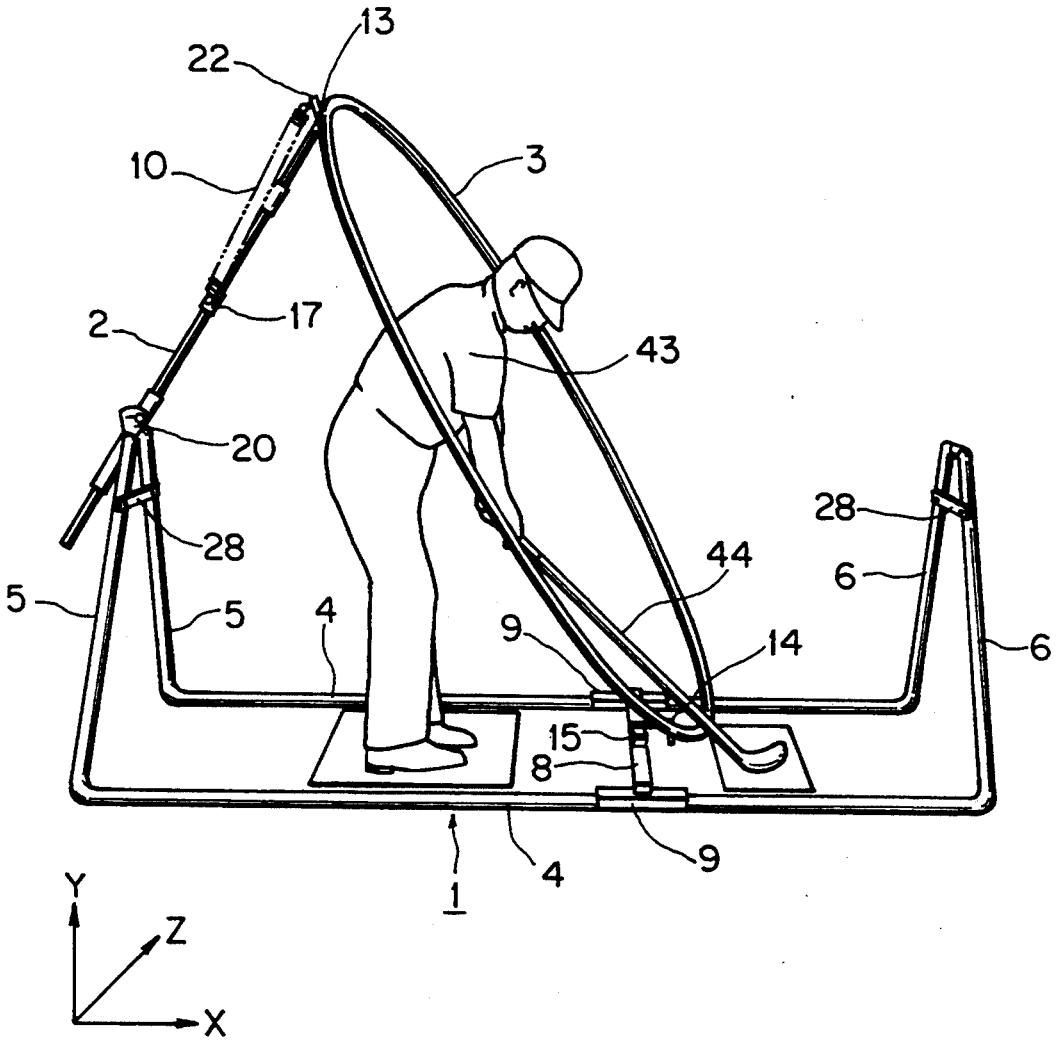
FIG. 1 is a right side view of a golf swing training device according to one embodiment of the present invention.

Referring now to the drawings, wherein like reference characters designate like or corresponding parts throughout the several views, there is shown in FIG. 1 a golf swing training device according to an embodiment of the present invention.

Figure 12:
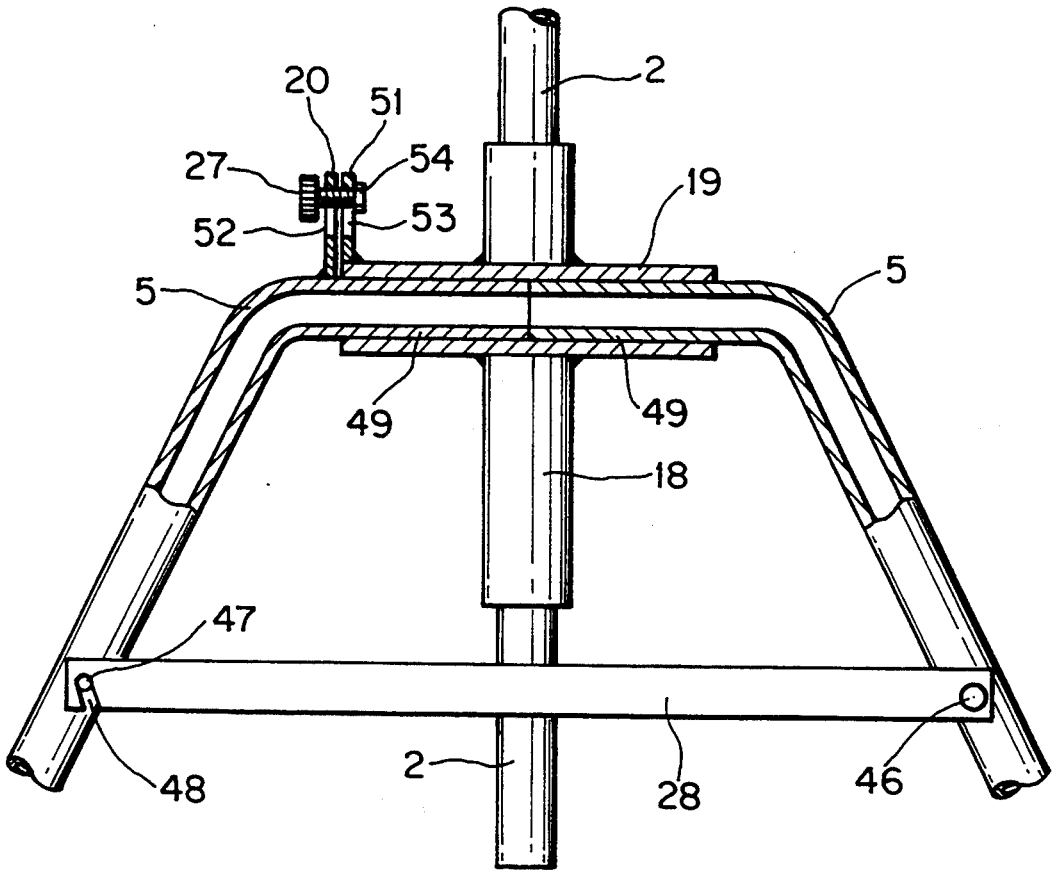
FIG. 12 is an enlarged front elevational view, partly in cross section, of FIG. 1.
Figure 13:
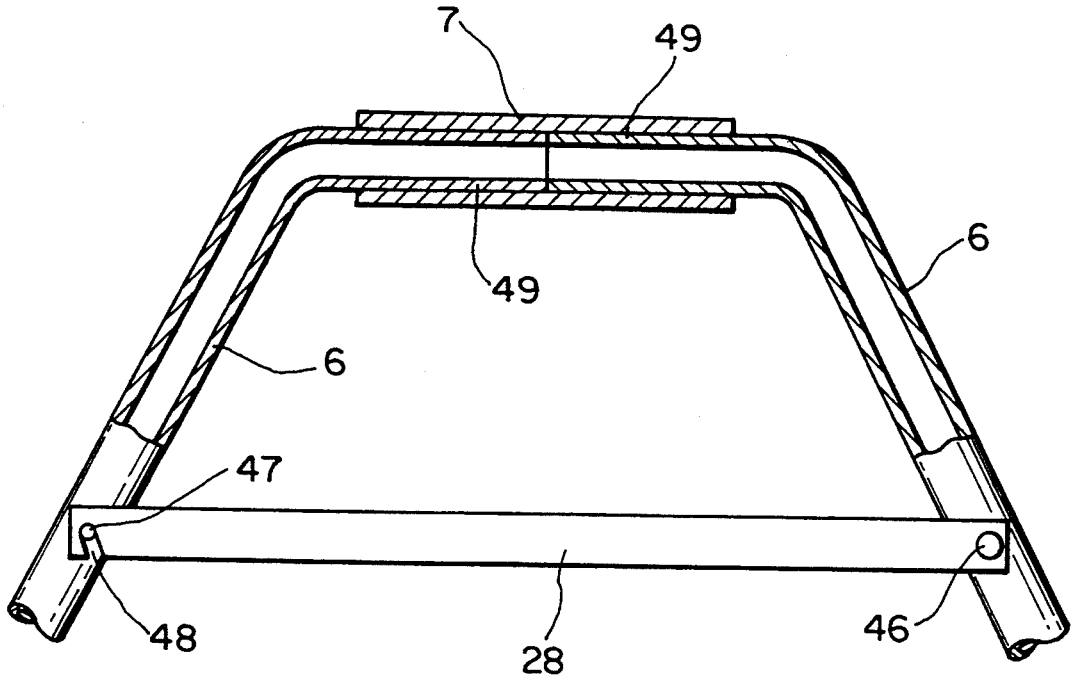
FIG. 13 is an enlarged rear view, partly in cross section, of an upper part of a second support frame portion of the golf swing training apparatus.

The golf swing training device includes a base frame 1 formed by assembling together a pair of symmetrical frame halves each formed from one pipe of metal or synthetic resin bent into a desired configuration. More spacifically, the pipes are bent successively in the Y-axis direction shown in FIG. 1, then in the X-axis direction, and subsequently in the Y-axis direction, thereby forming two generally U-shaped frame blanks each having a horizontal bottom frame portion 4 and a pair of first and second support frame portions 5, 6 extending upwardly and perpendicularly from opposite ends of the bottom frame portion 4. Subsequently, each of the frame blanks is shaped into one of the frame halves by bending the respective free end portions of the first and second support frame portions 5 and 6 in the Z-axis direction so as to form a pair of joint end portion 49, 49 (FIGS. 12 and 13). Two such frame halves are assembled together, with the joint end portions 49, 49 of one frame half held in abutment with the joint portions 49, 49 of the other frame half. The thus assembled base frame 1 has a trapezoidal shape having a top side shorter than the bottom, as viewed in a direction parallel to the longitudinal axis of the base frame 1.

The terms "front", "frontal", "forward" as used herein are intended to refer to the side or direction toward which the front side of the body of a right-handed player (trainee) faces. The first support frame portions 5, 5 of the golf swing training device are located at the rear end of the base frame 1, while the second support frame portions 6, 6 are located at the front end of the base frame 1.

A support member 2, preferably formed from a pipe of metal or synthetic resin, is detachably mounted on the first support frame portions 5 and held in an inclined or tilted condition. The support member 2 has an upper supporting point at its upper end and is movable in an axial direction (longitudinal direction) relative to the first support frame portions 5 so as to change or adjust the height of the upper supporting point. The support member 2 is also angularly movable in a vertical plane relative to the first support frame portions 5 so as to adjust or change the tilt angle of the support member 2. The upper end of the support member 2 is pivotally connected to a swing path guide loop 3 via an upper pivot member 13.

A pair of bottom support members 9, 9 is slidably fitted over the bottom frame portions 4, 4, respectively. The bottom support members 9, 9 are interconnected by a crossbar 8. As better shown in FIG. 2, the crossbar 8 has a central portion pivotally connected to the swing path guide loop 3 via a jack 15 serving as a height adjusting member for a lower supporting point, a plate-like support member 36, and a lower pivot member 14. The upper pivot member 13 and the lower pivot member 14 are diagonally aligned in a vertical plane and attached to the swing path guide loop 3 at diametrically opposite portions thereof.

The swing path guide loop 3 has a first hook 22 disposed on an upper portion of the swing path guide loop 3 and located at one side (right-hand side in FIG. 2) of the upper pivot member 13. A loop return spring 10 has one end (upper end) detachably hooked on the first hook 22, the other end (lower end) of the loop return spring 10 being connected to a tubular support member 17 slidably fitted around the support member 2. The loop return spring 10 in the illustrated embodiment is composed of a tension coil spring.

Figure 3:
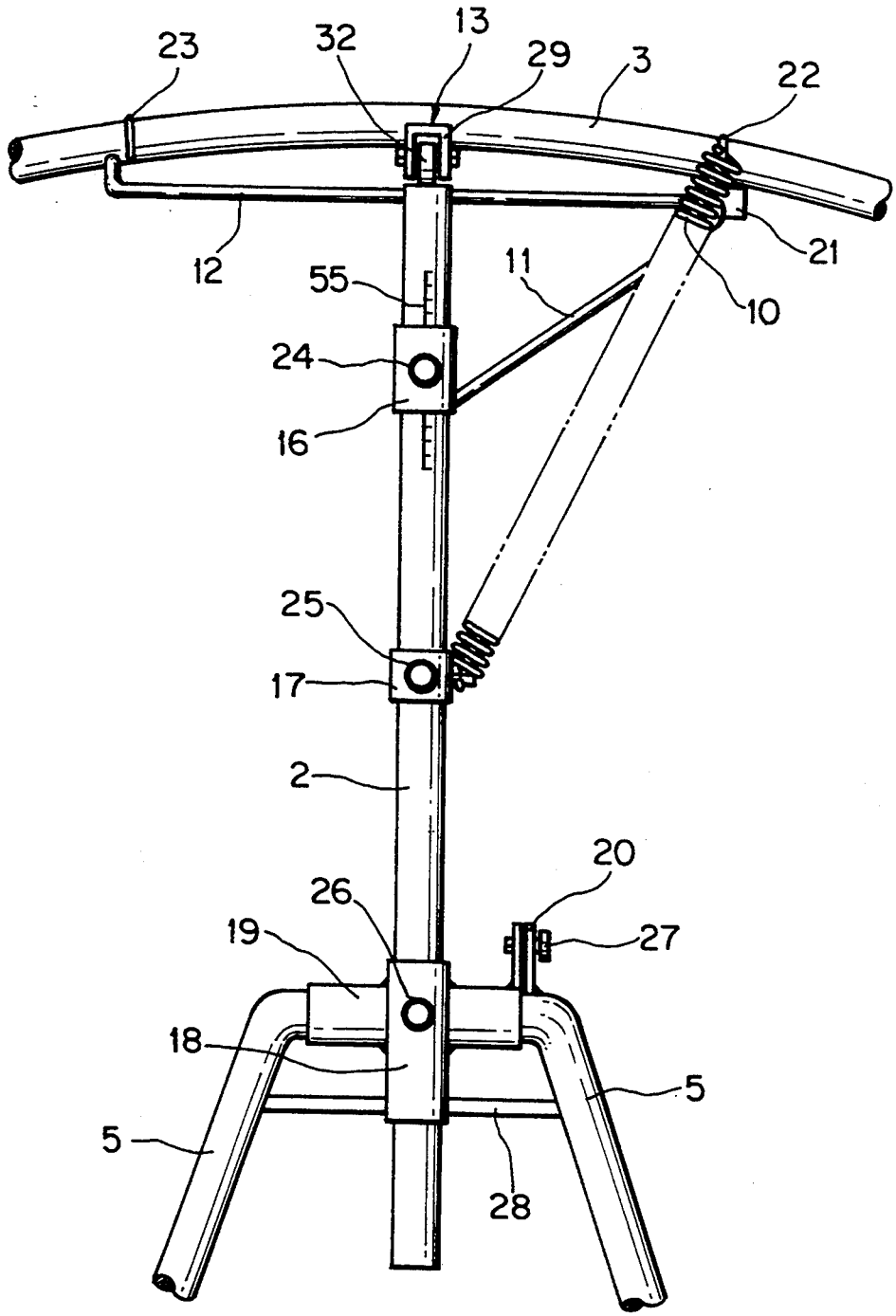
FIG. 3 is an enlarged rear view of a portion of the golf swing training apparatus, showing the connection between a first support frame portion, a support member and a swing path guide loop.

A reinforcing bar 12 is attached to, and extends horizontally across, the upper portion of the swing path guide loop 3 like a chord of a segment of a circle defined by the swing path guide loop 3. As best shown in FIG. 3, the reinforcing bar 12 has a right end which is engaged with a stopper 21 supported on one end (upper end) of a rod-like pivot-lock member 11. The other end (lower end) of the pivot-lock member 11 is pivotally connected to a tubular support member 16 slidably fitted around an upper portion of the support member 2. The tubular support member 16 is located above the tubular support member 17. With this construction, when the backswing is performed by a player or trainee 43 (FIG. 1), the club 44 engages the swing path guide loop 3 and may force a right side portion of the swing path guide loop 3 in the backward direction, tending to pivot or turn the swing path guide loop 3 in the clockwise direction about the upper and lower pivot members 13, 14. However, such a pivotal motion of the swing path guide loop 3 does not take place because the swing path guide loop 3 is prevented from so doing by virtue of the interlocking engagement between the reinforcing bar 12 and the stopper 21 of the swing-lock member 11.

The loop return spring 10, the pivot-lock member 11 including the stopper 21, and an end portion of the reinforcing bar 21 jointly constitute a motion control means or mechanism that control the movement of the swing path guide loop 3 such that the swing path guide loop 3 is incapable of pivoting about an axis passing through the upper and lower pivot portions 13, 14 during the backswing, is capable of pivoting in one direction about the axis by the force of the club 44 (FIG. 1) during the follow-through, and when pivoted during the follow-through, is capable of automatically returning to its original position.

Figure 2:
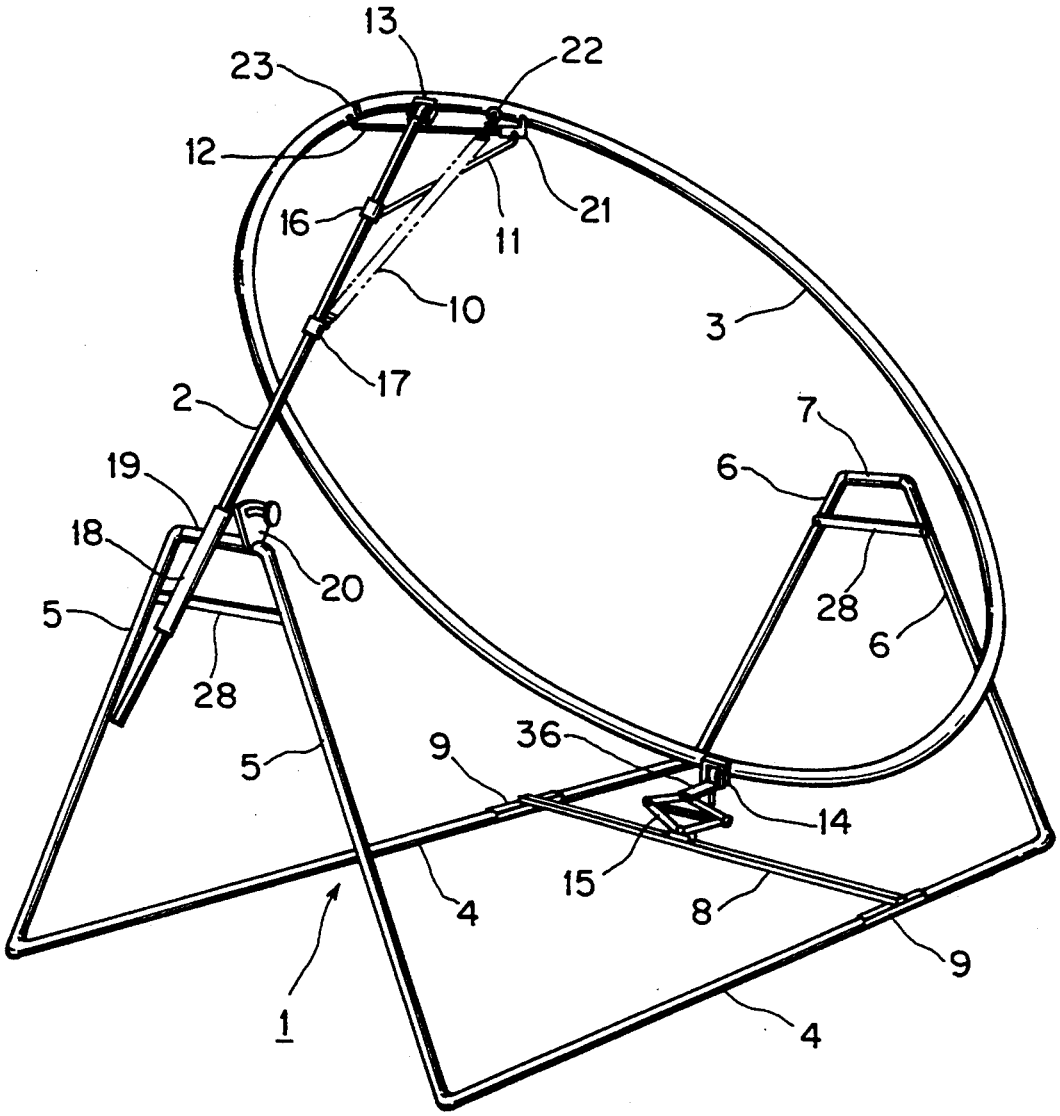
FIG. 2 is a perspective view of the golf swing training device of FIG. 1 from the right backside.

When the player is left-handed, the upper end of the loop return spring 10 is hooked on a second hook 23 which is disposed on the swing path guide loop 3 in a symmetrical relation to the first hook 22 about the upper pivot member 13, as shown in FIGS. 2 and 3. Then, the stopper 21 supported on the upper end of the pivot-lock member 11 is engaged with the left end of the reinforcing bar 12. Finally, the golf swing training device is turned through an angle of 180 degrees in a horizontal plane. Thus, the left-handed player can use the golf swing training device in the same manner as the right-handed player.

The support member 2 has a lower portion slidably fitted in a height adjusting tubular member 18, The height adjusting tubular member 18 extends crosswise of a horizontally extending, tilt angle adjusting tubular joint member 19 which is slidably fitted over the opposed joint end portions 49, 49 (FIG. 12) of the first support frame portions 5, 5. The height adjusting tubular member 18 is attached to the tilt angle adjusting tubular joint member 19. With this construction, the height of the upper supporting point on the swing path guide loop 3 can be adjusted by sliding the support member 2 upwards or downwards relative to the height adjusting tubular member 18, and rotating the tilt angle adjusting tubular joint member 9 about the joint end portions 49, 49 of the first-support frame portions 5, 5.

In FIGS. 1–3, numeral 20 denotes a tilt angle indicator associated with the support member 2, and numeral 28 denotes two identical connecting levers each of which is used to interconnect the two first support frame portions 5, 5 or the two second support frame portions 6, 6.

Figure 4:
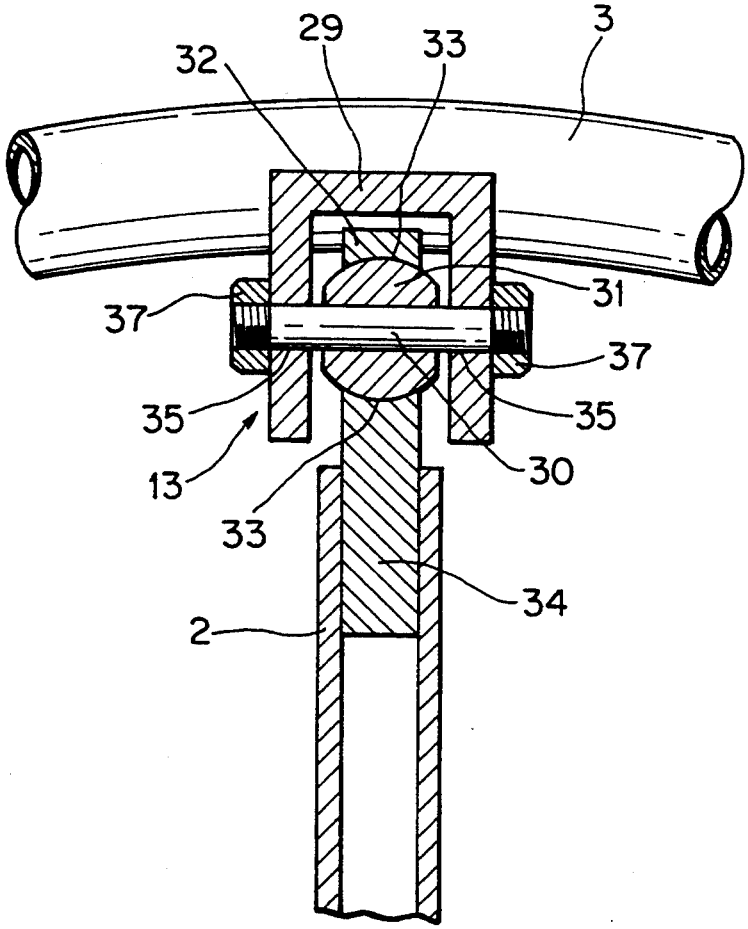
FIG. 4 is an enlarged rear view partly in cross section of a portion of the golf swing training device, showing the connection between the support member and the swing path guide loop.

As shown in FIGS. 3 and 4, the upper pivot member 13 is composed of a ball joint and includes a generally U-shaped bracket 29 secured by welding, for example, to a backwardly facing outer peripheral surface of the upper portion of the swing path guide loop 3, a spherical member or ball 31 having a spherical sliding surface 33, a ball retainer or socket 32 freely rotatably receiving therein the ball 31 and having a spherical sliding surface (not designated) slidably engageable with the spherical sliding surface 33 of the ball 31. The socket 32 and the ball 31 held therein are received in the bracket 29 and connected to the bracket 29 by means of a shaft 30 extending through a pair of aligned through-holes 35 in the bracket 29 diametrically across the ball 31. The shaft 30 is externally threaded at opposite ends. Two nuts 37, 37 are threaded over the threaded end portions of the shaft 30 to secure the shaft 30 to the bracket 29. With this construction, the relative motion between the ball 31 and the socket 32 is permitted within a certain angle in all planes passing through the shaft 30. The socket 32 is integrally formed at an end of a cylindrical rod 34. The rod 34 is firmly fitted in the upper end of the support member 2.

The tubular support member 16, which is slidably fitted around an upper portion of the support member 2 as shown in FIG. 3, is locked in a desired position by means of a first set screw 24. Similarly, the tubular support member 17, which is slidably fitted around the support member 2 for retaining the lower end of the loop return spring 10, is locked in a desired position by means of a second set screw 25. While the set screw 24, 25 are loosened, the tubular support members 16, 17 are slidably movable both in the longitudinal and circumferential directions of the support member 2. When the set screws 24, 25 are tightly fastened, the tubular support members 16, 17 are locked in position against displacement relative to the support member 2.

A third set screw 26 is threaded through the height adjusting tubular member 18 to lock the support member 2 in position against displacement relative to the height adjusting tubular member 18. To adjust the height of the upper supporting point on the supporting member 2, the third set screw 26 is loosened, and after that the support member 2 is slid downwards or upwards until a desired height of the upper supporting point is reached whereupon the third set screw 26 is tightly fastened to secure the support member 2 and the height adjusting tubular member 18. The support member 2 can be detached from, or inserted into, the height adjusting tubular member 18 while the third set screw 26 is loosened.

Figure 5:
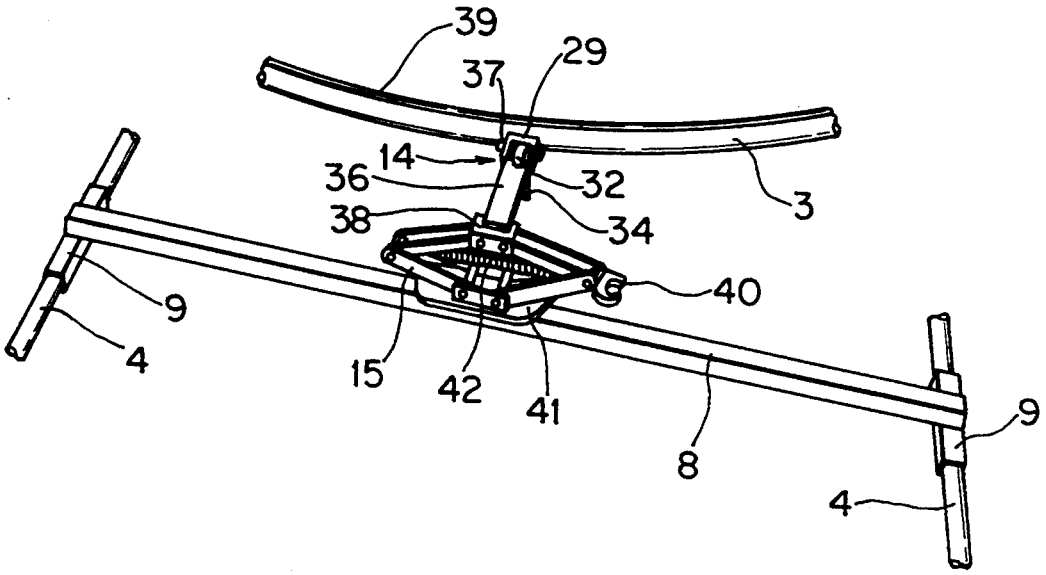
FIG. 5 is a perspective view of a portion of the golf swing training device, showing the relation between a bottom frame member and the swing path guide loop.
Figure 6:
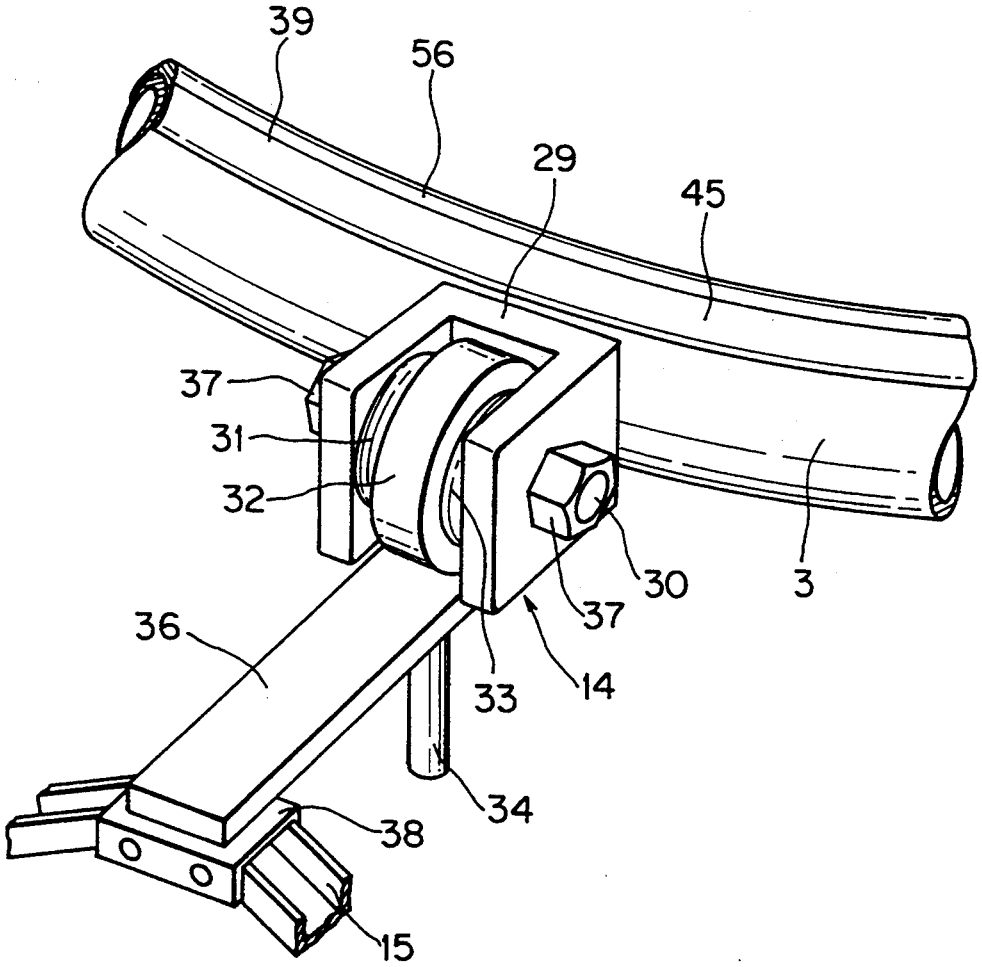
FIG. 6 is an enlarged perspective view showing the connection between the swing path guide loop and a lower pivot member of the golf swing training device.

FIGS. 5 and 6 show the lower pivot member 14 and related parts. The jack 15, serving as the height adjusting member for the lower supporting point, is secured by welding, for example, to a support plate 41 which is secured by welding, for example, to a central portion of the crossbar 8. The jack 15 is a screw jack generally known per se and has a top end 38 secured to a lower end of the plate-like support member 36. Numeral 42 denotes a screw for vertically expanding and contracting the jack 15, and numeral 40 denotes an actuating portion of the jack 15 for rotating the screw 42 to vary the overall height of the jack 15.

The lower pivot member 14 shown in FIG. 6 has substantially the same construction as the upper pivot member 13 described above with reference to FIG. 4. Therefore, the reference numerals designating corresponding parts are the same as those in FIG. 4. The upper pivot member 14 is composed of a ball joint and includes a generally U-shaped bracket 29 secured by welding, for example, to a backwardly facing outer peripheral surface of the lower portion of the swing path guide loop 3, a spherical member or ball 31 having a spherical sliding surface 33, a ball retainer or socket 32 freely rotatably receiving therein the ball 31 and having a spherical sliding surface (not designated) slidably engageable with the spherical sliding surface 33 of the ball 31. The socket 32 and the ball 31 held therein are received in the bracket 29 and connected to the bracket 29 by means of a shaft 30 extending through a pair of aligned through-holes (not shown but identical to those indicated by 35 shown in FIG. 4) in the bracket 29 diametrically across the ball 31. Two nuts 37, 37 are threaded over threaded opposite end portions of the shaft 30 to secure the shaft 30 to the bracket 29. With this construction, the relative motion between the ball 31 and the socket 32 is permitted within a certain angle in all planes passing through the shaft 30. The socket 32 is integrally formed at an end of a cylindrical rod 34. The rod 34 is fitted in a through-hole (not shown) formed in the plate-like support member 36, the rod 34 extending downwards across the thickness of the plate-like support member 36.

Figure 7:
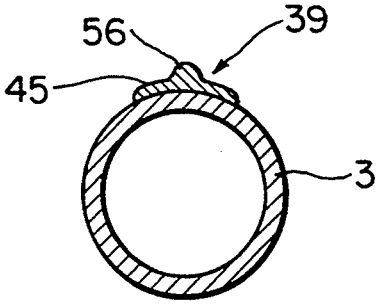
FIG. 7 is a transverse cross-sectional view of the swing path guide loop of the golf swing training device.

As shown in FIG. 7, the swing path guide loop 3 is formed from a pipe having a circular cross section and preferably made of metal, such as iron, aluminum, etc., or molded of a synthetic resin or a reinforced plastic. The forwardly facing outside surface of the swing path guide loop 3 is subjected to sliding engagement with the club 44 (FIG. 4). To protect the club 44 and the swing path guide loop 3, a club protection member 39 is attached to the forwardly facing outside surface of the swing path guide loop 3 along the full circumference of the swing path guide loop 3.

The club protection member 39 includes a round string 56 having a diameter much smaller than the outside diameter of the pipe of the swing path guide loop 3, and an attachment base portion 45. The string 56 and the attachment base portion 45 are integrally molded of synthetic resin and have a low friction coefficient. The string 56 thus molded forms a rib of a hemispherical cross section projecting from the attachment base portion 45. The attachment base portion 45 has a curved bottom surface having the same radius of curvature as the outside surface of the swing path guide loop 3, so that the curbed bottom surface can fit closely with the outside surface of the swing path guide loop 3 when the club protection member 39 is attached by bonding to the swing path guide loop 3 by means of an adhesive (not shown). The attachment base portion 45 has a relatively large width for a purpose of increasing the bonding strength between the club protection member 39 and the swing path guide loop 3.

As described above, the club protection member 39 is attached by bonding to that portion of the outside surface of the swing path guide loop 3 which is subjected to sliding contact with the club 44 (FIG. 1) when the player (trainee) 43 makes a complete movement known as the full swing. The string 36 of the club protection member 39 which is adapted to be engaged with the club 44 is molded of synthetic resin and has a smaller diameter than the pipe of the swing path guide loop 3. The club protection member 39 thus constructed only provides a narrow contact area with the result that the player 43 is able to swing the club 44 smoothly with least frictional resistance between the club 44 and the club protection member 39. Thus, the club 44 is completely free from damage.

Figure 8:
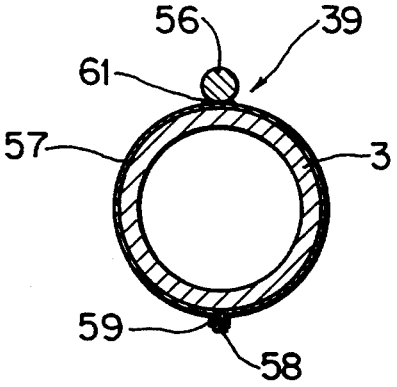
FIG. 8 is a view similar to FIG. 7, but showing a swing path guide loop according to another embodiment of the present invention.

FIG. 8 illustrates a modified form of the club protection member 39. The modified club protection member 39 includes a number of metal bands 57 (only one being shown) attached to the swing path guide loop 33 and spaced at equal intervals in the circumferential direction of the swing path guide loop 3. The metal bands 57 have a predetermined width and is coated with a synthetic resin film (not shown). The club protection member 39 further includes a substantially endless round string 56 of synthetic resin attached by bonding to the outside surface of the metal bands 57 by means of an adhesive 61 so that the string 56 extends along the full circumference of the swing path guide loop 3. The string 56 has a diameter much smaller than the outside diameter of the pipe of the swing path guide loop 3. Each of the metal bands 57 has a pair of flanges 58 at opposite ends thereof. The flanges 58 are fastened together by a suitable fastener, such as a bolt-and-nut fastener 59, so that each band 57 is clamped on the swing path guide loop 3.

Figure 9:
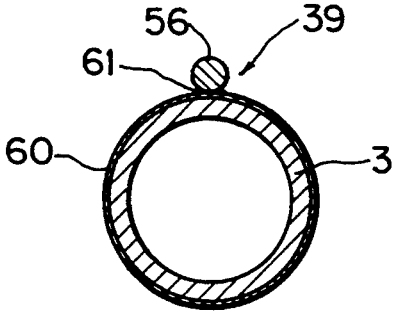
FIG. 9 is a view similar to FIG. 7, but showing a swing path guide loop according still another embodiment of the present invention.

Another modified club protection member 39 shown in FIG. 9 includes a number of strips of synthetic resin adhesive tape 60 of a predetermined width wound around the pipe of the swing path guide loop 3 at regular intervals in the circumferential direction of the swing path guide loop 3. A substantially endless round string 56 of synthetic resin is attached by bonding to the outside surfaces of the respective adhesive tapes 60 by means of an adhesive 61 such that the string 56 extends along the full circumference of the swing path guide loop 3. The string 56 has a diameter much smaller than the outside diameter of the pipe of the swing path guide loop 3 and also has a low friction resistance.

Figure 10:
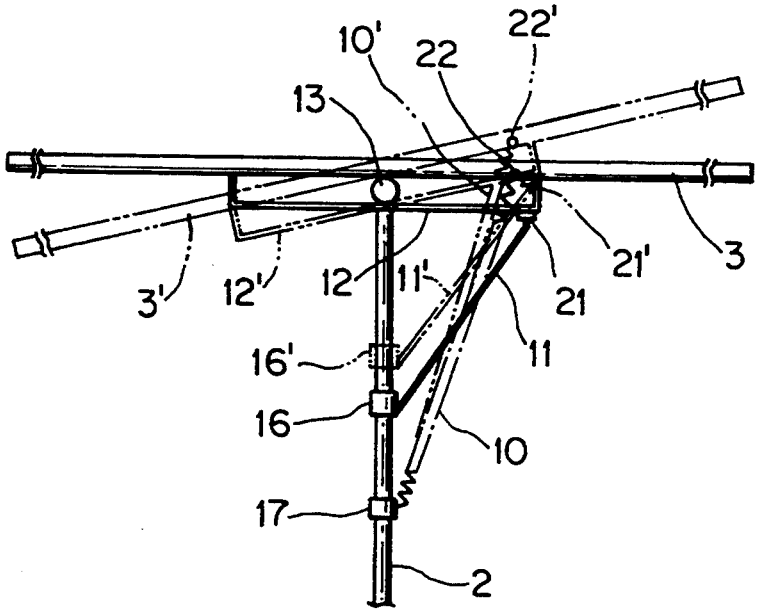
FIG. 10 is a fragmentary view in the direction of the swing plane, illustrating the operation of a ball flight direction change device associated with the swing path guide loop of the golf swing training device shown in FIG. 1.

FIG. 10 diagrammatically illustrates the manner in which a flight direction changing device associated with the swing path guide loop 3 operates. At first, the first set screw 24 (FIG. 3) on the tubular support member 16 is loosened, and then the tubular support member 16 is displaced upwardly along the support member 2 until it arrives at an upper position as indicated by the phantom lines in FIG. 10 and designated by numeral 16'. In response to the upward movement of the tubular support member 16, the stopper 21 supported on the upper end of the pivot-lock member 11 forces the right end of the reinforcing bar 12 forwardly against the force of the loop return spring 10, thereby causing the swing path guide loop 3 to turn in the counter-clockwise direction in FIG. 10 about an axis passing through the upper pivot member 13 and the lower pivot member 14 (FIGS. 1, 2 and 6) from the solid-lined square position to the phantom-lined, leftwardly pivoted position designated by numeral 3'. Thereafter, the first set screw 24 (FIG. 3) is tightly fastened to lock the tubular support member 16 in position against displacement relative to the support member 2. The intended flight direction of the ball, which is determined by the swing plane defined by the swing path guide loop 3, has been changed from the center toward the left. In FIG. 10, those reference numerals shown with the prime mark (') affixed thereto are used to indicate the respective positions of the corresponding parts which are assumed when the parts are displaced to change the intended ball flight direction.

It is obvious that even when the intended flight direction of the ball has been changed, the swing path guide loop 3 is incapable of pivoting during the backswing but is pivotally movable in one direction (counterclockwise direction in FIG. 10) under the force of the club 44 (FIG. 1) when a traveling path of the club 44 during the follow-through deviate from the swing plane, and when pivoted, the swing path guide loop 3 is able to automatically return to its original position.

When the intended flight direction of the ball is to be changed from the center toward the right, the tubular support member 16 shown in FIG. 10 is displaced downwards along the support member 2 to turn the swing path guide loop 3 clockwise about the axis passing through the upper pivot member 13 and the lower pivot member 14 (FIG. 6). As shown in FIG. 3, the golf swing training device has a flight direction indicator 55 provided on the support member 2 for indicating the intended flight direction of the ball which is set by the swing plane defined by the swing path guide loop 3. The flight direction indicator 55 comprises a graduation or scale marked on the outside surface of the support member 2 along a certain longitudinal portion of the latter within which the tubular support member 16 is displaceable. Since the pivot angle of the swing path guide loop 3 is variable with the position of the tubular support member 16 relative to the support member 2, a desired flight direction of the ball can be selected out, at the player's desire, among the right, center and left by adjusting the position of the tubular support member 16 using the flight direction indicator or scale 55.

Figure 11:
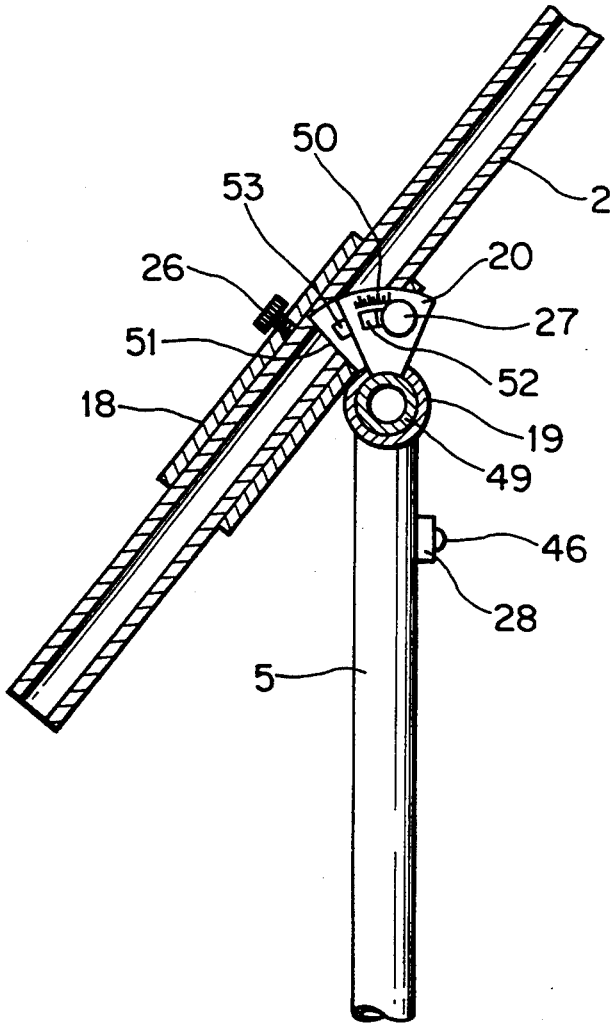
FIG. 11 is an enlarged side view, partly in cross section, of an upper part of the first support frame portion.

Referring now to FIGS. 11 and 12, description will be given of the manner in which the height of the upper supporting point of the support member 2 (namely, the upper pivot member 13) and the tilt angle of the swing path guide loop 3 are adjusted. Firstly, the third set screw 26 (FIG. 11) on the height adjusting tubular member 18 is loosened, and then the support member 2 is displaced upwards or downwards relative to the height adjusting tubular member 18 so that the upper pivot member 13 (FIGS. 1–4) forming the upper supporting point of the support member 2 reaches to a desired height. Thereafter, the third set screw 26 is tightly fastened to lock the height adjusting tubular member 18 in position against longitudinal displacement relative to the support member 2. The height of the upper supporting point of the support member 2 is thus adjusted.

On the other hand, to enable accurate adjustment of the tilt angle of the swing path guide loop 3, a tilt angle indicator 20, composed of a plate having the shape of a fan or a sector of a circle, is attached by welding, for example, to one of the first support frame portion 5 adjacent the joint end portion 49 thereof. Similarly, a tilt angle adjusting lug 51 in the form of a fan-shaped plate is attached by welding, for example, to one end of the tilt angle adjusting tubular joint member 19 which is attached by welding, for example, to the height adjusting tubular member 18 fitted around the support member 2. The fan-shaped tilt angle indicator 20 and the fan-shaped tilt angle adjusting lug 51 are disposed substantially in face to face confrontation with each other. The tilt angle indicator 20 has an arcuate oblong hole 52, and a graduation or scale 50 (FIG. 11) marked alongside of the oblong hole 52. The tilt angle adjusting lug 51 has an arcuate oblong hole 53 having the same radius of curvature as the arcuate oblong hole 52 in the tilt angle indicator 20. The tilt angle indicator 20 and the tilt angle adjusting lug 51 are connected together by a fourth set screw 27 extending successively through the oblong hole 52 and then through the oblong hole 53 and threaded in a nut 54 disposed behind the tilt angle adjustment lug 51.

With this construction, when the tilt angle of the support member 2 is to be changed, the fourth set screw 27 is loosened and subsequently the tilt angle adjusting tubular joint member 19 is rotated in either direction about the joint end portions 49, 49 of the first support frame portions 5, 5 until a desired tilt angle is set for the support member 2. Then, the fourth set screw 27 is tightly fastened to lock the tilt angle adjusting tubular joint member 19 in position against rotation relative to the joint end portions 49, 49. The tilt angle of the support member 2 can be read from the scale 50 by determining the position of one end of the oblong hole 53 relative to the scale 50, as shown in FIG. 11.

FIGS. 12 and 13 illustrate the joint portions between two frame halves of the base frame 1. As shown in FIG. 12, the joint end portions 49 of the respective first support frame portions 5, 5 are fitted in the tilt angle adjusting tubular joint member 19 from the opposite ends thereof and held in abutment with each other within the tilt angle adjusting tubular joint member 19. One of the connecting levers 28 is pivotally connected at one end to an upper portion of one of the first support frame portions 5 by means of a pivot pin 45. The opposite end of the connecting lever 28 has a locking recess 48 adapted to fit over a locking pin 47 provided on an upper portion of the other first support frame portion 5 in substantially horizontal alignment with the pivot pin 46. By virtue of interlocking engagement between the locking pin 47 and the recessed free end of the connecting lever 28, the two first support frame portions 5, 5 are held in assembled condition against accidental separation. As shown in FIG. 13, a tubular joint member 7 is fitted around the joint end portions 49, 49 of the respective second support frame portions 6, 6 to assemble them end to end. The other connecting lever 28 is pivoted at one end to an upper portion of one second support frame portion 6 by means of a pivot pin 46. A locking pin 47 is disposed on an upper portion of the other second support frame portion 6 in horizontal alignment with the pivot pin 46. The locking pin 47 is lockingly engageable with a locking recess 48 formed in the other or fee end of the connecting lever 28 to keep the two second support frame portions 6, 6 in assembled condition again accidental separation.

As described above, the golf swing training apparatus according to the present invention includes an upper pivot member mounted on a support member disposed on a base frame, a lower pivot member mounted on a bottom frame portion of the base frame, and a swing path guide loop attached to the upper and lower pivot members such that during the backswing, the swing path guide loop is incapable of pivoting about an axis passing through said upper and lower pivot members, during the follow-through, the swing path guide loop is capable of pivoting in one direction about the axis under the force of a club, and when pivoted, the swing path guide loop is capable of automatically returning to its original position. With the aid of the golf swing training device, the player or trainee is able to acquire a correct backswing achieved in the right swing plane. If the follow-through is deviated from the swing plane due to a bad way of the player's swing, such as the slice, the swing path guide loop pivots under the force of the club. The player can, therefore, correct the bad way of swing without having a feeling of resistance and continue to perform a smooth and resistance-free training of the swing.

The golf swing training device further includes a flight direction change means or mechanism associated with the swing path guide loop for changing the intended direction of the flight of a ball. The flight direction change mechanism is easy to operate and, hence, the ball flight direction defined by the plane of the swing path guide loop can be changed with utmost ease. The flight direction change mechanism includes a pivot-lock member which is used to prevent the swing path guide loop from pivoting or turning about an axis passing through the upper and lower pivot members, and also includes a loop return spring employed to urge the swing path guide loop to pivot in a direction opposite to the direction of pivotal movement of the swing path guide loop which may take place during the follow-through. The flight direction change mechanism is well adapted to both the right-handed players and the left-handed players only by selecting one of alternate attachment positions of the pivot-lock member and the loop return spring.

The golf swing training device of the present invention also includes a means or mechanism for adjusting the tilt angle of the swing path guide loop. Accordingly, in view of the height of a player (trainee) and the length to a club used, a suitable tilt angle can readily be set for the swing path guide loop.

The base frame of the golf swing training device is composed of a pair of symmetrical frame halves each formed from one pipe bent into a desired configuration, and a pair of pipes each fitted over a corresponding pair of opposed free ends of the pipes of the respective frame halves to assemble the frame halves. The base frame can be disassembled by removing the free ends of the frame halves from the tubular joint members. The base frame thus constructed is light in weight and strong in structure, and is convenient for transportation and storage.

By virtue of the lightweight base frame, the golf swing training device can readily be adaptable for both the right-handed players and the left-handed players by turning the entire device through an angle of 180 degrees in a horizontal plane.

The golf swing training device of the present invention further has a flight direction indicator provided on the support member for indicating the intended flight direction of the ball determined by the plane defined by the swing path guide loop. With the aid of the indicator, the difference, if any, between the intended flight direction and the actual flight direction can be visually confirmed, so that the player is able to correct a bad way of the swing.

The tilt angle of the swing path guide loop, which is adjusted by the tilt angle changing mechanism described above, is indicated by a tilt angle indicator provided on the base frame. The tilt angle indicator enables the player to visually confirm an optimum tilt angle which may vary depending on the height of the player and the length of the club used.

The swing path guide loop is provided with a club protection member which is attached to that side of an outer surface of the swing path guide loop which is subjected to sliding engagement with the club during the swing. With this construction, the club is smoothly slidable on and along the club protection member. Accordingly, the player is able to make the full swing without having a feeling of resistance and without causing any damage on the golf club. Since the swing is performed in a resistance-free manner, the player is able to correct a bad way of swing and eventually acquire a correct swing along the right swing plane.

The club protection member includes a round string made from a synthetic resin and adapted to be engaged with the club during the swing. The string has a diameter smaller than the outside diameter of the pipe of the swing path guide loop and, hence, provides only a narrow area for sliding engagement with the club. The string produces only a frictional resistance during the swing and hence ensures that the player makes the full swing in a soft and smooth manner.

Obviously, various minor changes and modifications of the present invention are possible in the light of the above teaching. It is therefore to be understood that within the scope of the appended claims the invention may be practiced otherwise than as specifically described.

What is claimed is:

1. A golf swing training device for assisting a player in acquiring a correct swing achieved in a swing plane throughout the movement of a club including the backswing, downswing, impact and follow-through, comprising:

(a) a base frame having a bottom frame portion;

(b) a support member disposed on said base frame and including an upper pivot member;

(c) a lower pivot member disposed on said bottom frame portion; and (d) a swing path guide loop defining the swing plane and attached to said upper and lower pivot members such that said swing path guide loop is incapable of pivoting about an axis passing through said upper and lower pivot portions during the backswing, is capable of pivoting in one direction about said axis by the force of the club during the follow-through, and when pivoted during the follow-through, is capable of automatically returning to its original position.

2. A golf swing training device according to claim 1, further including a loop return spring acting between said support member and said swing path guide loop to urge the latter to pivot about said axis in a second direction opposite to said one direction, a pivot-lock member attached to said support member and engageable with a portion of said swing path guide loop to prevent said swing path guide loop from pivoting about said axis in said second direction.

3. A golf swing training device according to claim 2, wherein said swing path guide loop has first and second hooks disposed in symmetrical relation with each other about said upper pivot member for retaining one end of said loop return spring, said pivot-lock member being also engageable with a second portion of said swing path guide loop which is located at the opposite side of said first-mentioned portion with respect to said upper pivot member, said first-mentioned portion and said second portion of said swing path guide loop being equidistant from said upper pivot member.

4. A golf swing training device according to claim 2, further including means for changing an intended flight direction of a ball which is determined by the swing plane defined by said swing path guide loop, wherein said support member is formed from a pipe, said intended flight direction changing means including a first tubular support member slidably fitted around said support member, a first fastener for locking said first tubular support member in position against displacement relative to said support member, a second tubular support member slidably fitted around said support member, and a second fastener for locking said second tubular supporting member in position against displacement relative to said support member, said pivot-lock member being pivotally connected to said first tubular support member, said loop return spring having one end secured to said second tubular support member.

5. A golf swing training device according to claim 4, further including means for indicating the intended flight direction of the ball.

6. A golf swing training device according to claim 5, wherein said intended flight direction indicating means includes a scale marked on an outer surface of said support member and extending along a limited longitudinal portion of said support member within which said first tubular support member is slidable.

7. A golf swing training device according to claim 1, further including means for adjusting the tilt angle of said swing path guide loop.

8. A golf swing training device according to claim 7, wherein said base frame has a horizontally extending tubular portion, said support member being formed from a pipe, said tilt angle adjusting means including a tilt angle adjusting tubular member slidably fitted around said horizontally extending tubular portion of said base frame, a height adjusting tubular member attached to said tilt angle adjusting tubular member and slidably fitted over said support member, a third fastener for locking said support member in position against displacement relative to said height adjusting tubular member, and a fourth fastener for locking said tilt angle adjusting tubular member in position against rotation relative to said horizontally extending tubular portion of said base frame.

9. A golf swing training device according to claim 8, further including means for indicating the tilt angle of said swing path guide loop.

10. A golf swing training device according to claim 9, wherein said tilt angle indicating means includes a tilt angle indicator plate attached to said base frame adjacent said horizontally extending tubular portion and having a first arcuate oblong hole, a tilt angle adjusting lug attached to an end of said tilt angle adjusting tubular member in substantially face to face confrontation with said tilt angle indicator plate and having a second arcuate oblong hole, a screw extending through said first and second arcuate oblong holes, a nut threaded over said screw to fasten said tilt angle indicator plate and said tilt angle adjusting lug, and a scale marked on a surface of said tilt angle indicator plate alongside of said first arcuate oblong hole.

11. A golf swing training device according to claim 1, wherein said base frame is composed of a pair of symmetrical frame halves each formed from one pipe bent into a desired configuration, and a pair of tubular joint members slidably fitted over corresponding ones of pairs of free ends of said pipes of said frame halves to join said frame halves.

12. A golf swing training device according to claim 1, further including a club protection member attached to that side of an outer surface of said swing path guide loop which is subjected to sliding engagement with the club, for protecting the club against damage.

13. A golf swing training device according to claim 12, wherein said swing path guide loop is formed from a pipe, and said club protection member includes a synthetic resin round string slidable engageable with the club, said round string having a low friction coefficient and having a diameter much smaller than the outside diameter of the pipe of said swing path guide loop.

14. A golf swing training device according to claim 13, wherein said club protection member further includes an attachment base portion integral with said round string and attached by bonding to said swing path guide loop.

15. A golf swing training device according to claim 13, wherein said club protection member further includes a number of metal bands attached to said swing path guide loop and spaced at regular intervals in the circumferential direction of said swing path guide loop, said round string being attached by bonding to said metal bands.

16. A golf swing training device according to claim 13, wherein said club protection member further includes a number of strips of adhesive tape wound around said swing path guide loop and spaced at regular intervals in the circumferential direction of said swing path guide loop, said round string being attached by bonding to said adhesive tape strips.

* * * * *